US005437807A

United States Patent [19]

Garabedian, Jr. et al.

[11] Patent Number: 5,437,807

[45] Date of Patent: * Aug. 1, 1995

[54] REDUCED RESIDUE HARD SURFACE CLEANER

[75] Inventors: Aram Garabedian, Jr., Fremont; Scott C. Mills, Livermore; William P. Sibert, Stockton, all of Calif.

[73] Assignee: The Clorox Company, Oakland, Calif.

[ * ] Notice: The portion of the term of this patent subsequent to Oct. 12, 2010 has been disclaimed.

[21] Appl. No.: 134,349

[22] Filed: Oct. 8, 1993

Related U.S. Application Data

[63] Continuation of Ser. No. 832,275, Feb. 7, 1992, Pat. No. 5,252,245.

[51] Int. Cl.[6] ..... C11D 1/50; C11D 3/26

[52] U.S. Cl. ..... 252/153; 252/173; 252/547; 252/546; 252/DIG. 10

[58] Field of Search ..... 252/153, 173, 547, 546, 252/DIG. 10

[56] References Cited

U.S. PATENT DOCUMENTS

| | | | |
|---|---|---|---|
| H,468 | 5/1988 | Malik et al. | 252/542 |
| 3,173,876 | 3/1965 | Zobris | 252/137 |
| 3,615,825 | 10/1971 | Gansser | 134/38 |
| 3,679,608 | 7/1972 | Aubert et al. | 252/526 |
| 3,839,234 | 10/1974 | Roscoe | 252/544 |
| 3,882,038 | 5/1975 | Clayton et al. | 252/164 |
| 3,912,662 | 10/1975 | Martinsson et al. | 252/527 |
| 3,960,782 | 6/1976 | Daley et al. | 252/544 |
| 4,069,066 | 1/1978 | Hindle et al. | 134/6 |
| 4,107,095 | 8/1978 | Klisch et al. | 252/541 |
| 4,115,548 | 9/2978 | Marsh et al. | 424/70 |
| 4,213,873 | 7/1980 | Church | 252/174.21 |
| 4,302,348 | 11/1981 | Requejo | 252/135 |

(List continued on next page.)

FOREIGN PATENT DOCUMENTS

| | | | |
|---|---|---|---|
| 288856A | 11/1985 | European Pat. Off. | 252/170 |
| 344847 | 12/1989 | European Pat. Off. . | |
| 0393772 | 10/1990 | European Pat. Off. . | |
| 0428816 | 5/1991 | European Pat. Off. . | |
| 0442251 | 8/1991 | European Pat. Off. . | |
| 3213896 | 3/1993 | Japan . | |
| 3215122 | 3/1993 | Japan . | |
| 2133415 | 7/1981 | United Kingdom . | |
| 2133415 | 7/1984 | United Kingdom | 252/544 |
| 2160887 | 1/1986 | United Kingdom . | |
| 91/11505 | 8/1991 | WIPO . | |

OTHER PUBLICATIONS

Chem. Abs. 75:65509r (1971).

WIPO/EPO Search Report on PCT/US 93/00599 (equivalent to U.S. Ser. No. 07/832,274, parent hereof).

Dowanol Glycol Esters for Household, Commercial and Industrial Cleaning Products (1991).

*Primary Examiner*—Paul Lieberman
*Assistant Examiner*—Michael P. Tierney
*Attorney, Agent, or Firm*—Joel J. Hayashida; Michael J. Mazza; Harry A. Pacini

[57] ABSTRACT

The invention provides an aqueous, hard surface cleaner with significantly improved residue removal and substantially reduced filming/streaking, said cleaner comprising:

(a) an effective amount of a solvent selected from $C_{1-6}$ alkanol, $C_{3-24}$ alkylene glycol ether, and mixtures thereof;

(b) an effective amount of a surfactant selected from amphoteric, nonionic and anionic surfactants, and mixtures thereof;

(c) an effective amount of a buffering system which comprises a nitrogenous buffer selected from the group consisting of:

ammonium or alkaline earth carbamates, guanidine derivatives, alkoxylalkylamines and alkyleneamines; and (d) the remainder as substantially all water.

12 Claims, 6 Drawing Sheets

OTHER PUBLICATIONS

| | | | |
|---|---|---|---|
| 4,904,359 | 2/1990 | Parche et al. | 252/548 |
| 4,921,679 | 5/1990 | Makik et al. | 252/170 |
| 4,948,531 | 8/1990 | Fuggini et al. | 252/544 |
| 4,976,885 | 12/1990 | Wisotzki et al. | 252/174.17 |
| 5,030,374 | 7/1991 | Tranner | 252/90 |
| 5,093,031 | 3/1992 | Cogin et al. | 252/357 |
| 5,102,573 | 4/1992 | Han et al. | 252/153 |
| 5,106,525 | 4/1992 | Sullivan | 252/162 |
| 5,108,660 | 4/1992 | Michael | 252/545 |
| 5,126,068 | 6/1992 | Burke et al. | 252/174.21 |
| 5,232,632 | 8/1993 | Woo et al. | 252/546 |
| 5,252,245 | 10/1993 | Garabedian, Jr. et al. | 252/153 |
| 5,294,644 | 3/1994 | Cogin et al. | 514/698 |
| 5,342,549 | 8/1994 | Michael | 252/546 |
| 4,315,828 | 2/1982 | Church | 252/153 |
| 4,421,680 | 12/1988 | Shivar | 252/526 |
| 4,673,523 | 6/1987 | Smith et al. | 252/91 |
| 4,681,704 | 7/1987 | Bernardino et al. | 252/546 |
| 4,690,779 | 9/1987 | Baker et al. | 252/546 |
| 4,784,786 | 11/1988 | Smith et al. | 252/91 |
| 4,797,231 | 1/1989 | Schumann et al. | 252/547 |
| 4,863,629 | 9/1989 | Osberghaus et al. | 252/162 |

REDUCED RESIDUE HARD SURFACE CLEANER

This is a continuation of application Ser. No. 07/832,275, filed Feb. 7, 1992, now U.S. Pat. No. 5,252,245.

BACKGROUND OF THE INVENTION

1. Field of the Invention

The invention relates to a non-rinse, isotropic hard surface cleaner especially adapted to be used on glossy or smooth, hard surfaces, such as glass windows and the like, which removes soils deposited thereon, while significantly reducing the amount of residue caused by unremoved soil, cleaner, or a combination thereof.

2. Brief Statement of the Related Art

Cleaning hard, glossy surfaces such as glass windows has proven to be problematic. To remove soils deposited on such surfaces, the typical approach is to use an alkaline ammonium-based aqueous cleaner or other aqueous cleaners containing various mixtures of surfactants and other cleaning additives. Unfortunately, many of the ammonia-based cleaners have fairly poor soil removing ability, while many of the surfactant-based cleaners leave fairly significant amounts of residue on such hard, glossy surfaces. This residue is seen in the phenomena of streaking, in which the soil, cleaner, or both are inconsistently wicked off the surface, and filming, in which a thin layer of the residue actually clings to the surface desired to be cleaned.

Baker et al., U.S. Pat. No. 4,690,779, demonstrated a hard surface cleaner having improved non-streaking-/filming properties in which a combination of low molecular weight polymer (e.g., polyethylene glycol) and certain surfactants were combined.

Corn et al., E.P. 0393772 and E.P. 0428816, describe hard surface cleaners containing anionic surfactants with ammonium counterions, and additional adjuncts.

G.B. 2,160,887 describes a cleaning system in which a combination of nonionic and anionic surfactants (including an alkanolamine salt alkyl sulfate) is contended to enhance cleaning efficacy.

WO 91/11505 describes a glass cleaner containing a zwitterionic surfactant, monoethanolamine and/or betaaminoalkanols as solvents/buffers for assertedly improving cleaning and reducing filming spotting.

SUMMARY OF THE INVENTION AND OBJECTS

The invention provides an aqueous, hard surface cleaner with significantly improved residue removal and substantially reduced filming/streaking, said cleaner comprising:

(a) an effective amount of a solvent selected from $C_{1-6}$ alkanol, $C_{3-24}$ alkylene glycol ether, and mixtures thereof;

(b) an effective amount of a surfactant selected from amphoteric, nonionic and anionic surfactants, and mixtures thereof;

(c) an effective amount of a buffering system which comprises a nitrogenous buffer selected from the group consisting of:

ammonium or alkaline earth carbamates, guanidine derivatives, alkoxylalkylamines and alkyleneamines; and (d) the remainder as substantially all water.

In another embodiment of the invention, the cleaner further comprises (e) an effective amount of a 1-alkyl-2-pyrrolidone. This particular adjunct has proven to be surprisingly effective at both dispersing highly insoluble organic materials, particularly, fragrance oils, while simultaneously enhancing or maintaining the effective minimization of streaking/filming of the surfaces cleaned with the inventive cleaner.

In yet a further aspect of the invention, it has been additionally surprisingly found that particular alkylene glycol ether solvents and magnesium salts will further enhance cleaning performance.

It is an additional aspect of the invention to enhance the performance of the buffering system by adding a co-buffer, such as an alkaline hydroxide, in particular, either an ammonium or alkaline earth metal hydroxide.

The invention further comprises a method of cleaning soils from hard surfaces by applying said inventive cleaner to said soil, and removing both from said surface.

It is therefore an object of this invention to improve soil removal from hard surfaces.

It is another object of this invention to reduce filming which results from a residue of cleaner, soil, or both remaining on the hard surface intended to be cleaned.

It is a further object of this invention to reduce streaking, which results from inconsistent removal of the cleaner, soil, or both, from the hard surface intended to be cleaned.

It is a still further object of this invention to improve overall cleaning performance by using an improved buffer system comprising a nitrogenous buffer, especially, carbamates, guanidine derivatives, alkoxylalkylamines and alkyleneamines, and, optionally, an alkaline hydroxide as a further co-buffer, in addition to the foregoing.

It is also an object of this invention to provide a cleaner for glass and other hard, glossy surfaces, which has virtually no filming or streaking.

It is an additional object of this invention to provide a stably fragranced hard surface cleaner, without losing substantially any cleaning performance because of the addition of such fragrance.

It is yet another object of this invention to limit the total amount of alkali metal salts, especially sodium, present in the formulation.

DETAILED DESCRIPTION OF THE INVENTION

Figure 1:
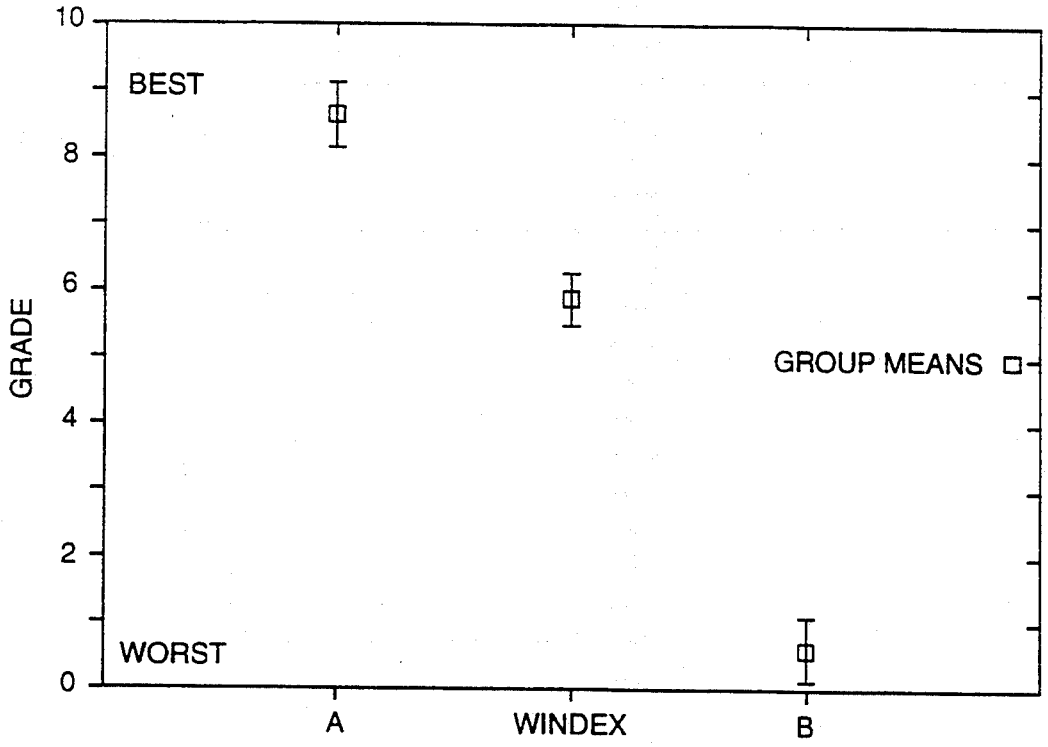
FIG. 1 is a graphical depiction of the streaking/filming performance of the invention versus comparative examples.

The invention is an improved cleaning, substantially nonstreaking/filming hard surface cleaner especially adapted to be used on glossy or smooth, hard surfaces, emblematic of which is glass. The cleaner benefits from the use of a novel buffering system which contributes unexpectedly to the complete removal of soils and the cleaner from the surface being cleaned. The cleaner itself has the following ingredients:

(a) an effective amount of a solvent selected from $C_{1-6}$ alkanol, $C_{3-24}$ alkylene glycol ether, and mixtures thereof;

(b) an effective amount of a surfactant selected from amphoteric, nonionic and anionic surfactants, and mixtures thereof;

(c) an effective amount of a buffering system which comprises a nitrogenous buffer selected from the group consisting of:

ammonium or alkaline earth carbamates, guanidine derivatives, alkoxylalkylamines and alkyleneamines; and (d) the remainder as substantially all water.

Additional adjuncts in small amounts such as fragrance, dye and the like can be included to provide desirable attributes of such adjuncts. In a further embodiment of the invention, especially when a fragrance is used, a further adjunct (e) a 1-alkyl-2-pyrrolidone is added in amounts effective to disperse the fragrance and to improve or maintain the reduced streaking/filming performance of the inventive cleaner.

In the application, effective amounts are generally those amounts listed as the ranges or levels of ingredients in the descriptions which follow hereto. Unless otherwise stated, amounts listed in percentage ("%'s") are in weight percent of the composition, unless otherwise noted.

1. Solvents

The solvent is selected from $C_{1-6}$ alkanol, $C_{3-24}$ alkylene glycol ether, and mixtures thereof. It is preferred that a mixture of the $C_{1-6}$ alkanol and $C_{3-24}$ alkylene glycol ether solvents be used. The alkanol can be selected from methanol, ethanol, n-propanol, isopropanol, butanol, pentanol, hexanol, their various positional isomers, and mixtures of the foregoing. In the invention, it has been found most preferable to use isopropanol, usually in conjunction with a glycol ether. It may also be possible to utilize in addition to, or in place of, said alkanols, the diols such as methylene, ethylene, propylene and butylene glycols, and mixtures thereof.

The alkylene glycol ether solvents can include ethylene glycol monobutyl ether, ethylene glycol monopropyl ether, propylene glycol monopropyl ether, propylene glycol monobutyl ether, and mixtures thereof. One preferred glycol ether is ethylene glycol, monobutyl ether, also known as butoxyethanol, sold as butyl Cellosolve by Union Carbide. A particularly preferred alkylene glycol ether is propylene glycol, t-butyl ether, which is commercially sold as Arcosolve PTB, by Arco Chemical Co. It has the structure:

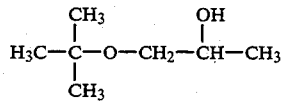

It has been unexpectedly found that the propylene glycol t-butyl ether is especially preferred in the formulations of the invention. This particular solvent readily improves the non-streaking/non-filming performance. If mixtures of solvents are used, the amounts and ratios of such solvents used are important to determine the optimum cleaning and streak/film performances of the inventive cleaner. It is preferred to limit the total amount of solvent to no more than 50%, more preferably no more than 25%, and most preferably, no more than 15%, of the cleaner. A preferred range is about 1–15%, and if a mixed solvent system of alkanol/glycol ether is used, the ratio of alkanol to alkylene glycol ether should be about 1:20 to 20:1, more preferably about 1:10 to 1:10 and most preferably about 1:5 to 5:1.

2. Surfactants

The surfactant is selected from artionic, nonionic and amphoteric surfactants, and mixtures thereof.

The anionic surfactant is selected from alkyl sulfates, alkylbenzene sulfonates, α-olefin sulfonates, alkyl taurates, alkyl sarcosinates and the like. Each of these surfactants is generally available as the alkali metal, alkaline earth and ammonium salts thereof. The preferred anionic surfactant is alkyl sulfate, more preferably, $C_{6-16}$ alkyl sulfates. One particularly preferred sulfate is sodium lauryl ($C_{12}$) sulfate, available from Stepan Chemical Co., under the brand name Stepanol WAC. Because it appears desirable to limit the total amount of sodium ion present in the invention, it may also be preferred to use the alkaline earth salts of alkyl sulfates, particularly magnesium, and, less preferably, calcium, to bolster non-streaking/non-filming performance. Magnesium salts of the anionic surfactants are commercially available, however, a viable alternative is to form the magnesium salts in situ by the addition of soluble $Mg^{++}$ salts, such as $MgCl_2$, and the like. Calcium salts suitable for use would be $CaCl_2$, and the like. The level of these salts may be as high as 200 ppm, although less than 100 ppm is preferred, especially less than 50 ppm.

The nonionic surfactants are selected from alkoxylated alcohols, alkoxylated ether phenols, and other surfactants often referred to as semi-polar nonionics, such as the trialkyl amine oxides. The alkoxylated alcohols include ethoxylated, and ethoxylated and propoxylated $C_{6-16}$ alcohols, with about 2–10 moles of ethylene oxide, or 1–10 and moles of ethylene and propylene oxide per mole of alcohol, respectively. The semi-polar amine oxides are preferred. These have the general configuration:

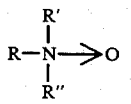

wherein R is $C_{6-24}$ alkyl, and R′ and R″ are both $C_{1-4}$ alkyl, although R′ and R″ do not have to be equal. These amine oxides can also be ethoxylated or propoxylated. The preferred amine oxide is lauryl amine oxide, such as Barlox 12, from Lonza Chemical Company.

The amphoteric surfactant is typically an alkylbetaine or a sulfobetaine. Especially preferred are alkylamidoalkyldialkylbetaines. These have the structure:

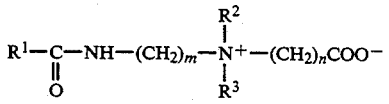

wherein $R^1$ is $C_{6-20}$ alkyl, $R^2$ and $R^3$ are both $C_{1-4}$ alkyl, although $R^2$ and $R^3$ do not have to be equal, and m can be 1–5, preferably 3and n can be 1-5, prefereably 1. These alkylbetaines can also be ethoxylated or propoxylated. The preferred alkylbetaine is a cocoamidopropyldimethyl betaine called Lonzaine CO, available from Lonza Chemical Co. Other vendors are Henkel KGaA, which provides Velvetex AB, and Sherex Chemical Co., which offers Varion CADG, both of which products are cocobetaines.

The amounts of surfactants present are to be somewhat minimized, for purposes of cost-savings and to generally restrict the dissolved actives which could contribute to leaving behind residues when the cleaner is applied to a surface. However, the amounts added are generally about 0.001–1%, more preferably 0.002–0.75% anionic surfactant, generally about 0–1%, more preferably 0–0.75% nonionic surfactant and generally 0.005–2%, more preferably 0.01–1% amphoteric surfactant, in the cleaner. The ratios of surfactants are generally about 1:1:10 to 10:1:1 anionic/nonionic/amphoteric, when all three are present. If just two surfactants are used, the ratios will be about 1:20 to 20:1.

3. Alkylpyrrolidones

The 1-alkyl-2-pyrrolidones provide a dual function in this invention. First, one of the desirable adjuncts which are added to this system are fragrances, which are typically water-immiscible to slightly water-soluble oils. In order to keep this fairly immiscible component in solution, a cosolvent or other dispersing means was necessary. It was determined that 1-alkyl-2-pyrrolidones were particularly effective at so solubilizing the fragrance oils. However, it was further surprisingly found that the 1-alkyl-2-pyrrolidones also improve the cleaning performance of the cleaner, especially in streaking-/filming. The compound has the general structure:

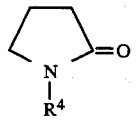

wherein $R^4$ is a $C_{6-20}$ alkyl, or $R^5NHCOR^6$, and $R^5$ is $C_{1-6}$ alkyl and $R^6$ is $C_{6-20}$ alkyl. A particularly preferred alkyl pyrrolidone is lauryl pyrrolidone, sold by GAF Corporation under the brand name Surfadone. Relatively low amounts of the alkyl pyrrolidone are used, preferably, about 0.001–0.5%, when the level of fragrance is from about 0.01–0.5%.

4. Buffer System

The buffer system comprises a nitrogenous buffer selected from the group consisting of: ammonium or alkaline earth carbamates, guanidine derivatives, alkoxylalkylamines and alkyleneamines. Optionally and preferably, a co-buffer selected from ammonium and alkaline earth metal hydroxides, is also desirable.

The nitrogenous buffer is the most important aspect of the invention. Because of its presence, greatly enhanced reduction in streaking and filming of hard surfaces is achieved after -the inventive cleaner is used to clean the same. The preferred nitrogenous buffer is ammonium carbamate, which has the structure $NH_2COO^-NH^+_4$. Use of this particularly preferred buffer obtains outstanding reduction in filming/streaking. Other, suitable buffers are guanidine derivatives, such as diaminoguanidine and guanidine carbonate; alkoxylalkylamines, such as isopropoxypropylamine, butoxypropylamine, ethoxypropylamine and methoxypropylamine; and alkylamines, such as ethyleneamine, ethylenediamine, ethylenetriamine, ethylenetetramine, diethylenetetramine, triethylenetetramine, tetraethylenepentamine, N,N-dimethylethylenediamine, N-methylenediamine, and other variations of the alkyl and amine substituents. Mixtures of any of the foregoing can be used as the buffer in the buffering system.

Additionally, it is especially preferred to add, as a cobuffer, an ammonium or alkaline earth hydroxide. Most preferred is ammonium hydroxide, which volatilizes relatively easily after being applied, resulting in minimal residue. Ammonium hydroxide also emulsifies fatty soils to a certain extent.

The amount of nitrogenous buffer added should be in the range of 0.01–2%, more preferably 0.01–1%, by weight of the cleaner, while hydroxide, if present, should be added in the range of 0.001–1% by weight of the cleaner.

5. Water and Miscellaneous

Since the cleaner is an aqueous cleaner with relatively low levels of actives, the principal ingredient is water, which should be present at a level of at least about 50%, more preferably at least about 80%, and most preferably, at least about 90%. Deionized water is most preferred.

Small amounts of adjuncts can be added for improving cleaning performance or aesthetic qualities of the cleaner. Adjuncts for cleaning include additional surfactants, such as those described in *Kirk-Othmero Encyclopedia of Chemical Technology,* 3rd Ed., Volume 22, pp. 332–432 (Marcel-Dekker, 1983), which are incorporated herein by reference. Inorganic builders, such as silicates and phosphates, are generally avoided in this cleaner, especially those which will contribute a large amount of solids in the formulation which may leave a residue. Aesthetic adjuncts include fragrances, such as those available from Givaudan, IFF, Quest and others, and dyes and pigments which can be solubilized or suspended in the formulation, such as diaminoanthraquinones. As mentioned above, the fragrance oils typically require a dispersant, which role is fulfilled by the alkylpyrrolidone. As previously noted, it was surprising that the fragrance was well dispersed by the alkylpyrrolidone while at least maintaining, if not improving, the non-streaking/non-filming performance of the inventive cleaner. The amounts of these cleaning and aesthetic adjuncts should be in the range of 0–2%, more preferably 0–1%.

In the following Experimental section, the surprising performance benefits of the various aspects of the inventive cleaner are demonstrated.

It should be noted that in each study, the experimental runs are replicated and the average, generally, of each set of runs is plotted on the graphs depicted in the drawings accompanying this application. Thus, the term "Group Means" is used to describe the average of each set of runs. Generally, the plotted points on the graphs are boxes, representing the group means, through which error bars overlap. Error bars overlap if the difference between the means is not significant at the 95% level using Fisher's LSD (least significant difference).

EXPERIMENTAL

The following experiments demonstrate the unique cleaning performance of the inventive cleaner.

EXAMPLE I

In Table I below, a base formulation "A" is set forth, and, for comparison, an alternate formulation "B" is provided. Generally, the below examples of the compositions of this invention will be based on the base formulation "A."

TABLE I

| Ingredient | Formulation A | Formulation B |
|---|---|---|
| iso-Propyl Alcohol | 5.90% | 5.90% |
| Propyleneglycol t-Butyl Ether | 3.20% | 3.20% |
| Sodium Lauryl Sulfate | 0.005% | 0.005% |
| Dodecyl Pyrrolidone | 0.012% | 0.012% |
| Cocoamidobetaine | 0.20% | 0.20% |
| Ammonium Carbamate | 0.25% | — |
| Sodium Carbonate | — | 0.25% |
| Fragrance | 0.125% | 0.125% |
| Ammonia | 0.05% | 0.05% |
| Deionized Water | remainder to 100% | remainder to 100% |

The formulations A (invention) and B were then tested by placing a small sample on glass mirror tiles and then wiped off. In addition, a commercial glass cleaner (Windex, Drackett Co.), was similarly tested. The results were graded on a scale of 1 to 10, with 1 being the worst and 10, the best. The results, depicted in FIG. 1, clearly show that inventive cleaner A demonstrated superior streaking/filming performance.

EXAMPLE II

This next example compares the soil removal performance of the inventive cleaner, using a variety of different buffer systems, versus comparative buffers. In these examples, the following base formulation was used:

TABLE II

| Ingredients | Weight Percent |
|---|---|
| Propylene glycol, t-Butyl Ether | 3.2 |
| Isopropanol | 5.9 |
| Cocoamidopropyldimethybetaine | 0.17 |
| Dodecylpyrrolidone | 0.012 |
| Sodium Lauryl Sulfate | 0.005 |
| Fragrance | 0.125 |
| Buffer | 0.5 |
| Colorants | Negligible |
| Ammonia | 0.05 |

TABLE II-continued

| Ingredients | Weight Percent |
|---|---|
| Deionized Water | Balance to 100% |

Into this base formulation of Table II, 0.5% of the following buffers of Table III were added:

TABLE III

| | Code |
|---|---|
| Inventive Buffer | |
| Guanidine Carbonate | GC |
| Triethylenetetramine | TETA |
| Tetraethylenepentamine | TEPA |
| Ammonium Carbamate | Carbamate |
| Diethylenetriamine | DETA |
| Isopropoxypropylamine | IPP |
| Methoxypropylamine | MPA |
| Other Buffers/Cleaners | |
| Monoisopropanolamine | MIPA |
| Monoethanolamine | MEA |
| Cinch Multi-Surface Cleaner[1] | Cinch |
| 3-Amino-1-Propanol | AP |

[1]Procter & Gamble Co.

In this EXAMPLE II, soil removal from selected panels was conducted using a Gardner WearTester, in which a sponge (5 g) and a 1kg weight were loaded onto the WearTester's reciprocating arm. Each panel was loaded with a 50 μm thickness of a fabricated soil called "kitchen grease." The soil removal is measured as a change from shading from the initial reading (soiled) to the final reading (cleaned). In this particular study, this measurement was obtained using an image processor, which consists of a video camera connected to a microprocessor and a computer which are programmed to digitize the image of the soiled panel and to compare and measure the difference in shading between the soiled and cleaned panel. Using this system, a performance scale of 1000–3000 was used, with 1000 being worst and 3000 being best.

Figure 2:
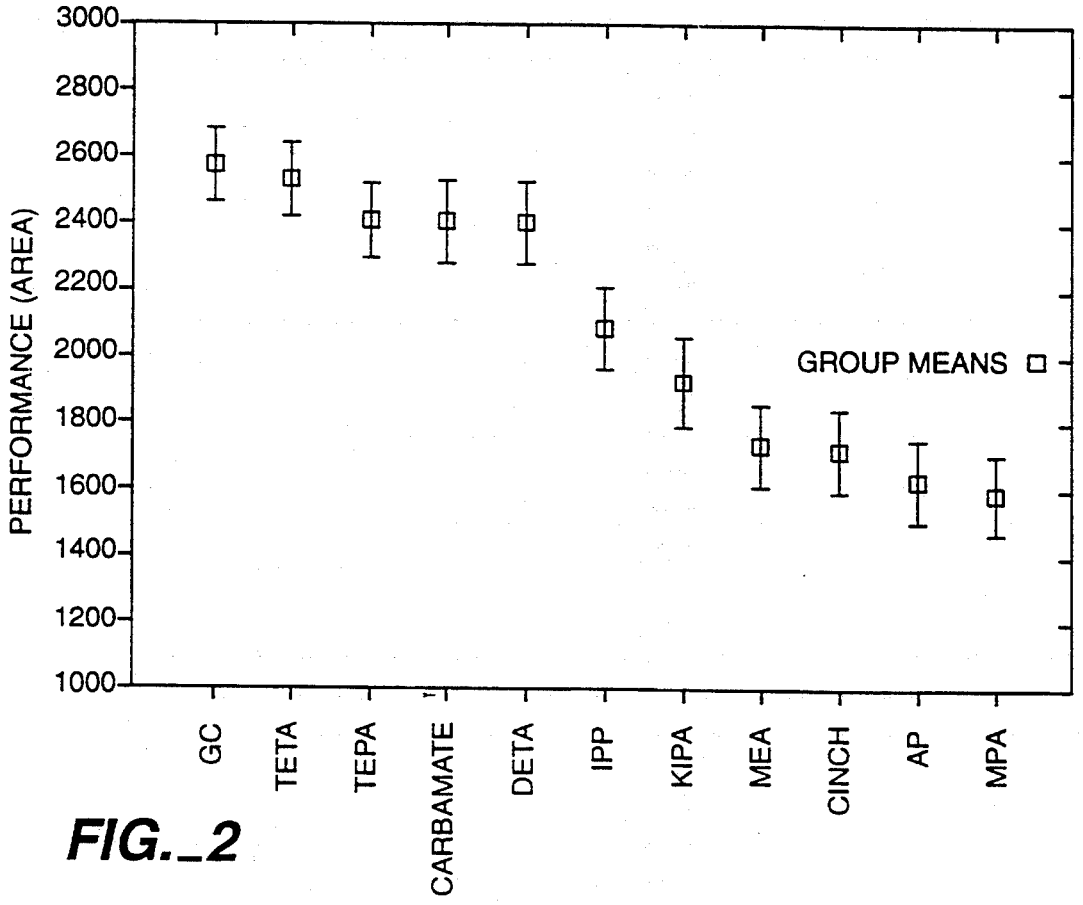
FIG. 2 is a graphical depiction of the soil removal performance of the inventive cleaner with various buffers, as compared to comparative formulations.

As shown in FIG. 2 of the accompanying drawings, the inventive formulations (GC, TETA, TEPA, Carbamate, DETA and IPP) outperformed the comparison examples. MPA (inventive formulation), on the other hand, had results generally at parity with the comparison examples.

EXAMPLE III

In this EXAMPLE III, the same base formulation as depicted in Table II was used, and the following buffers were used, as described in Table IV:

TABLE IV

| | Code |
|---|---|
| Inventive Buffer | |
| Triethylenetetramine | TETA |
| Ethylenediamine | EDA |
| N,N-Dimethylethylenediamine | DMEDI |
| Other Buffers/Cleaners | |
| Monoethanolamine | MEA |
| Cinch Multi-Surface Cleaner | Cinch |
| 1-Amino-2-Propanol | AP |
| Morpholine | Morph |
| 2-(t-Butylamine)Ethanol | t-BAE |

Figure 3:
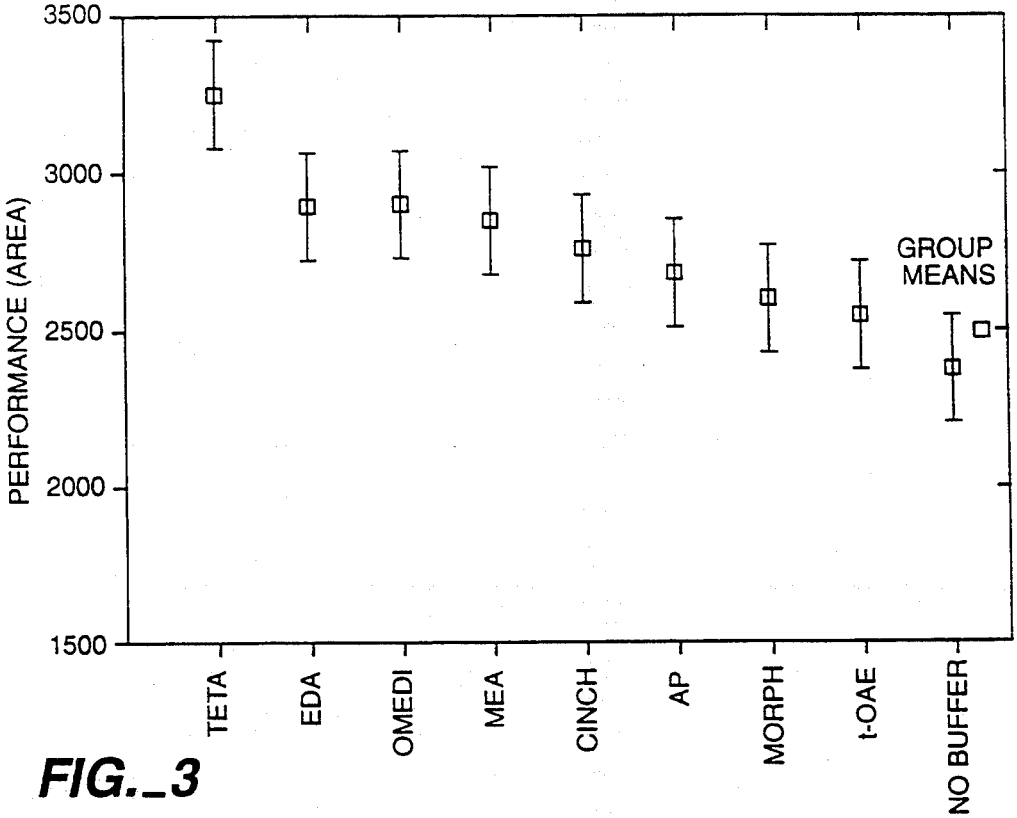
FIG. 3 is another graphical depiction of the soil removal performance of the inventive cleaner with various buffers, as compared to comparative formulations.

In this EXAMPLE III, again, 50 μm of "kitchen grease" were loaded onto panels and cleaned using a Gardner WearTester. This time, the image processor measured the difference between soiled and cleaned panels on a performance scale of 1500–3000, with 1500 being worst and 3000 being best. Again, with reference to FIG. 3 of the accompanying drawings, it is again observed that the inventive formulations (TETA, EDA and DMEDI) were better than the comparison examples.

EXAMPLE IV

Figure 4:
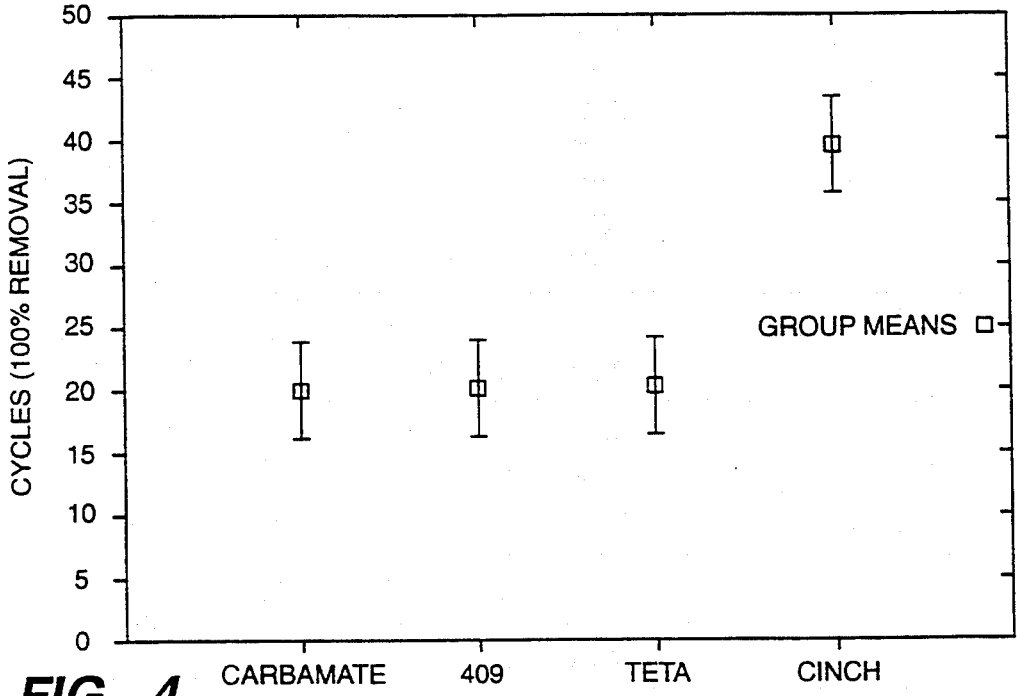
FIG. 4 is a further graphical depiction of the soil removal performance (cycles to 100% removal) of the inventive cleaner with various buffers, as compared to comparative formulations.

In this example, removal of a larger amount of "kitchen grease" soil (150 μm) is demonstrated. However, the base formulation of Table II is varied by using only 7.9% total solvent. As in that example, 0.5% inventive buffer was added to the inventive cleaner. Thus, two inventive formulations designated "Carbamate" (Ammonium Carbamate) and "TETA" (Triethylenetetramine) were compared against Cinch Multi-Surface Cleaner and Formula 409® all purpose cleaner. This particular study was a "Cycles to 100% Removal Study," in which the number of complete cycles of the reciprocating arm of the Gardner WearTester necessary to result in 100% removal of the soil were counted on a scale of 0 to 50, with higher numbers being worst and lower numbers being better. As can be seen in FIG. 4 of the accompanying drawings, the inventive formulations Carbamate and TETA were comparable with the excellent performance of the commercial Formula 409® cleaner, while all were markedly better than the Cinch Multi-Surface Cleaner.

EXAMPLE V

Figure 5:
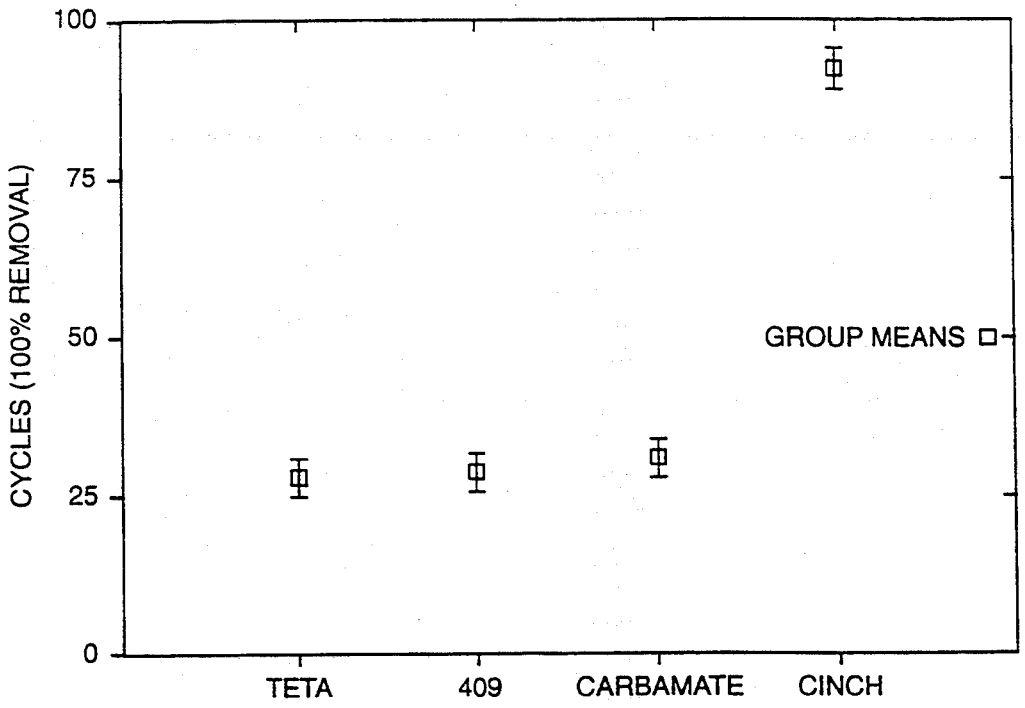
FIG. 5 is yet another graphical depiction of the soil removal performance (cycles to 100% removal) of the inventive cleaner with various buffers, as compared to comparative formulations.

In this example, variations on the inventive formulations previously presented above in EXAMPLE IV were demonstrated. In the TETA formulation, an alternate alkylene glycol ether, propylene glycol n-butyl ether, was used, rather than propylene glycol t-buryl ether. Additionally, in this example, the number of cycles to remove 100% of the soil (150 μm "kitchen grease") were counted on a scale of 0 to 100, again, with 100 being worst and 0 being best. The results here (shown, again, by reference to FIG. 5 of the accompanying drawings) were not significantly different, since again, the TETA and Carbamate formulations performed on par with the Formula 409® Cleaner, although the better results for the TETA demonstrate that excellent performance can result when an alternate solvent is used.

EXAMPLE VI

In this example, the soil removal of a specially developed soil called "bathroom soil" (a mixture of dirt, calcium stearate (soap scum) and other ingredients to attempt to replicate a typical bathtub soil) was visually assayed by a trained panel of 10–20 people, whose visual grades of the soil removal performances were averaged. The inventive cleaner had the following formulation:

TABLE V

| Ingredients | Weight Percent |
|---|---|
| Propyleneglycol, t-Butyl Ether | 3.200 |
| Isopropanol | 5.900 |
| Dodecylpyrrolidone | 0.012 |
| Sodium Lauryl Sulfate | 0.005 |
| Fragrance | 0.125 |
| Ammonium Carbamate | 0.250 |
| Ammonia | 0.05 |
| Cocoamidopropyldimethylbetaine | 0.20 |
| Colorants | Minor |
| Deionized Water | Balance to 100% |

This formulation of Table V was compared against 7 commercially available cleaners for soil removal of "bathroom soil". However, in this study, the soil removal was observed after 7 cycles of the Gardner WearTester were completed. A visual grading scale of 1–10* was used, with 1 being no cleaning and 10 being clean. The results are shown below in Table VI:

*Based on standards

TABLE VI

| Cleaner | Visual Grading (1–10) (1 = no cleaning; 10 = clean) |
|---|---|
| Invention (Table V) | 9.2 |
| Professional Strength Windex | 9.0 |
| Glass Plus | 8.9 |
| Formula 409 (+ 0.5% $NH_4$ Carbamate) (No NaOH) | 8.9 |
| Pine Sol Spray | 8.3 |
| Cinch Multi-Surface | 4.3 |
| Formula 409 | 4.0 |
| Whistle | 1.3 |
| Windex | 1.3 |

Figure 6:
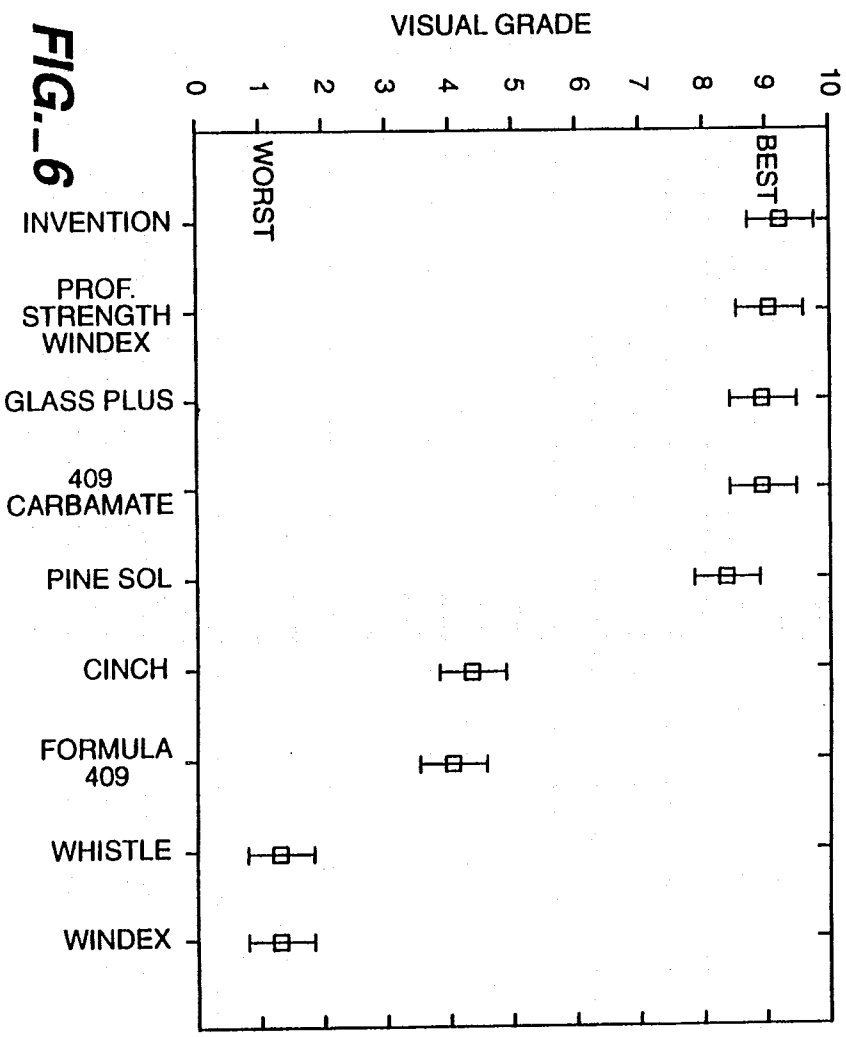
FIG. 6 is a still further graphical depiction of the soil removal performance (visual gradation) of the inventive cleaner with various buffers, versus commercial formulations.

The above results show that the inventive formulation with a carbamate buffer significantly outperformed commercially available cleaners for "bathroom soil" removal through 7 cycles. However, the example for Formula 409® all purpose cleaner with the addition of 0.5% carbamate, an example which falls within the invention, shows the significant improvement in performance when this inventive buffer is added to a commercial cleaner. The results are also graphically depicted in FIG. 6 of the accompanying drawings.

EXAMPLE VII

Example VII now demonstrates that within the invention, the level of sodium ions should be controlled in order to obtain the best performance in reducing streaking/filming. Thus, three formulations were prepared as described in Table VII below:

TABLE VII

| Ingredient | Formulation Weight Percent A | B | C |
|---|---|---|---|
| Isopropanol | 5.90 | 5.90 | 5.90 |
| Propyleneglycol t-Butyl Ether | 3.20 | 3.20 | 3.20 |
| Sodium Lauryl Sulfate | 0.005 | — | 0.05 |
| Dodecylpyrrolidone | 0.012 | 0.012 | 0.012 |
| Cocoamidopropyldimethyl betaine | 0.20 | 0.20 | 0.20 |
| Ammonium Carbamate | 0.25 | 0.25 | 0.25 |
| Fragrance | 0.125 | 0.125 | 0.125 |
| Ammonia | 0.05 | 0.05 | 0.05 |
| Deionized Water | Balance to 100% | Balance to 100% | Balance to 100% |

The three formulations A, B and C were compared against one another and against a commercially available cleaner, Windex (Drackett Co.), for filming/streaking performance on glass mirror tiles (Examples 8–9 below also involved streaking/filming performance on glass mirror tiles). Again, a grading scale of 0 to 10 was used, with 0being worst and 10 being best. Formulation A, with 0.005% sodium lauryl sulfate ("SLS") performed the best. Omitting the SLS (Formulation B) worsens the performance somewhat, indicating that the antonic surfactant is a desirable cleaning adjunct, but adding 10 times as much SLS (Formulation C, 0.050% SLS) can worsen performance more.

Figure 7:
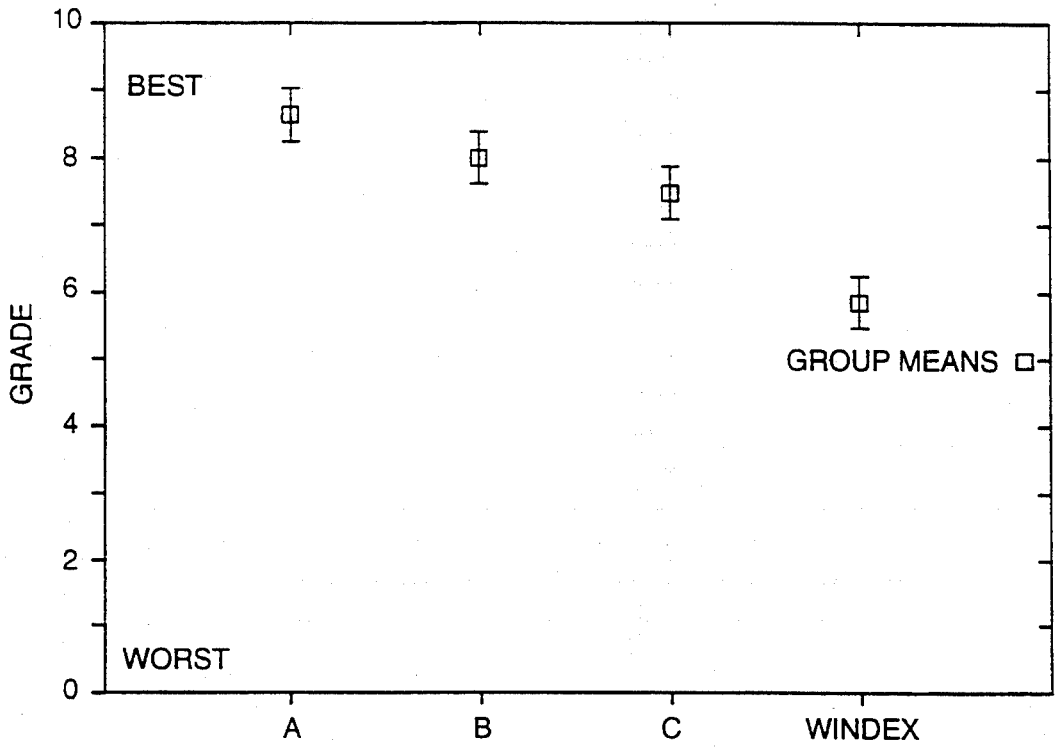
FIG. 7 is another graphical depiction of the streaking/filming performance of the inventive cleaner, compared to a commercial window cleaner.

As can be seen from FIG. 7 of the accompanying drawings, however, each of Formulations A, B and C outperformed the commercially available Windex cleaner, thus attesting to the inventive cleaner's superior performance in reducing filming/streaking.

EXAMPLE VIII

In this example, a further aspect of the invention is demonstrated. This is the importance of adding a 1-alkyl-2-pyrrolidone to the formulation when a fragrance oil is present was demonstrated. Formulation A contained a dodecylpyrrolidone as the dispersant for the fragrance oil. Formulation B contained no dispersant. Formulation C contained an ethoxylated phenol as an intended dispersant for the fragrance oil. Additionally, Windex was also tested as a comparison example. The formulations for A, B and C are depicted below in Table VIII.

TABLE VIII

| Ingredient | Formulation Weight Percent | | |
|---|---|---|---|
| | A | B | C |
| Isopropanol | 5.90 | 5.90 | 5.90 |
| Propyleneglycol t-Butyl Ether | 3.20 | 3.20 | 3.20 |
| Sodium Lauryl Sulfate | 0.005 | 0.005 | 0.005 |
| Dodecylpyrrolidone | 0.012 | — | — |
| Ethoxylated Phenols | — | — | 0.012 |
| Cocoamidopropyldimethyl-betaine | 0.20 | 0.20 | 0.20 |
| Ammonium Carbamate | 0.25 | 0.25 | 0.25 |
| Fragrance | 0.125 | 0.125 | 0.125 |
| Ammonia | 0.05 | 0.05 | 0.05 |
| Deionized Water | Balance to 100% | Balance to 100% | Balance to 100% |

Figure 8:
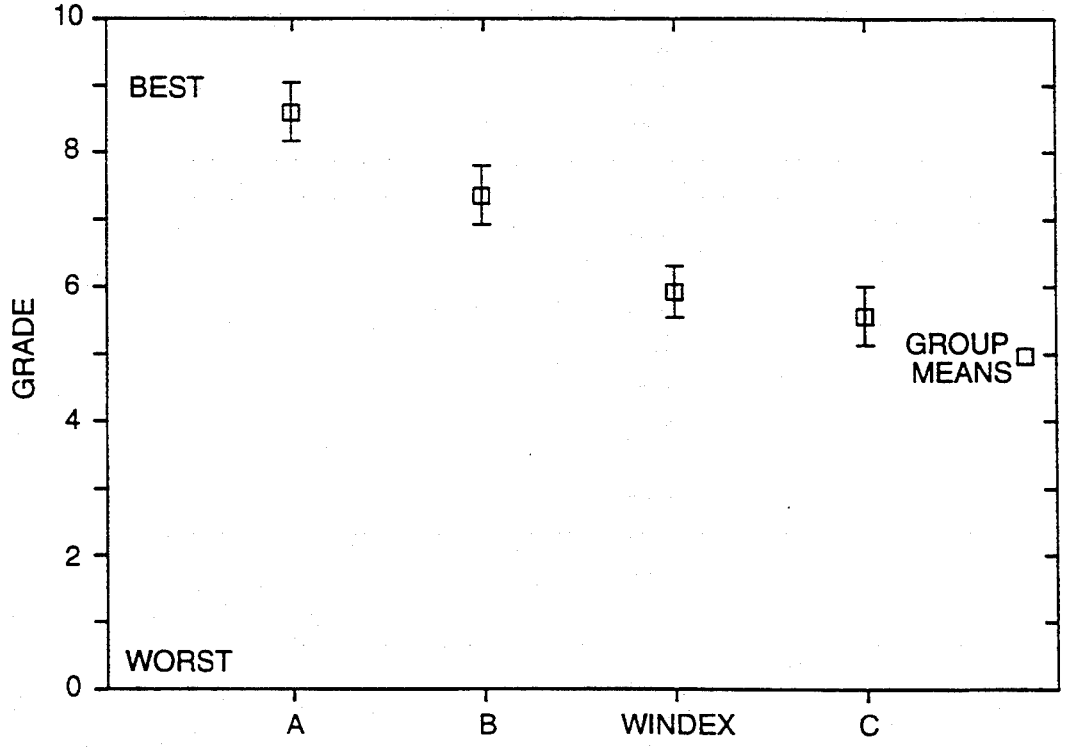
FIG. 8 is yet another graphical depiction of the streaking/filming performance of the inventive cleaner, including comparison versus a commercial window cleaner.

This Example VIII shows that within the invention, it is highly preferred to use a 1-alkyl-2-pyrrolidone as a dispersant for the fragrance oil, if the latter is included in the cleaners of this invention. Although formulations B and C are both within the invention, it can be seen that omission of the pyrrolidone worsens the streaking-/filming performance somewhat, while substituting ethoxylated phenols worsens the performance even more. The Windex cleaner was shown to be somewhat on parity with Formulation C. This is graphically depicted in FIG. 8 of the accompanying drawings.

EXAMPLE IX

In this example, the effect of the preferred solvent, propyleneglycol t-butyl ether is studied (formulation A). It is compared against another inventive formulation, B, which contains ethyleneglycol n-butyl ether. The formulations are set forth in Table IX:

TABLE IX

| Ingredient | Formulation Weight Percent | |
|---|---|---|
| | A | B |
| Isopropanol | 5.90 | 5.90 |
| Ethyleneglycol n-Butyl Ether | — | 3.20 |
| Propyleneglycol t-Butyl Ether | 3.20 | — |
| Sodium Lauryl Sulfate | 0.005 | 0.005 |
| Dodecylpyrrolidone | 0.012 | 0.012 |
| Cocoamidopropyldimethyl-betaine | 0.20 | 0.20 |
| Ammonium Carbamate | 0.25 | 0.25 |
| Fragrance | 0.125 | 0.125 |
| Ammonia | 0.05 | 0.05 |
| Deionized Water | Balance to 100% | Balance to 100% |

Figure 9:
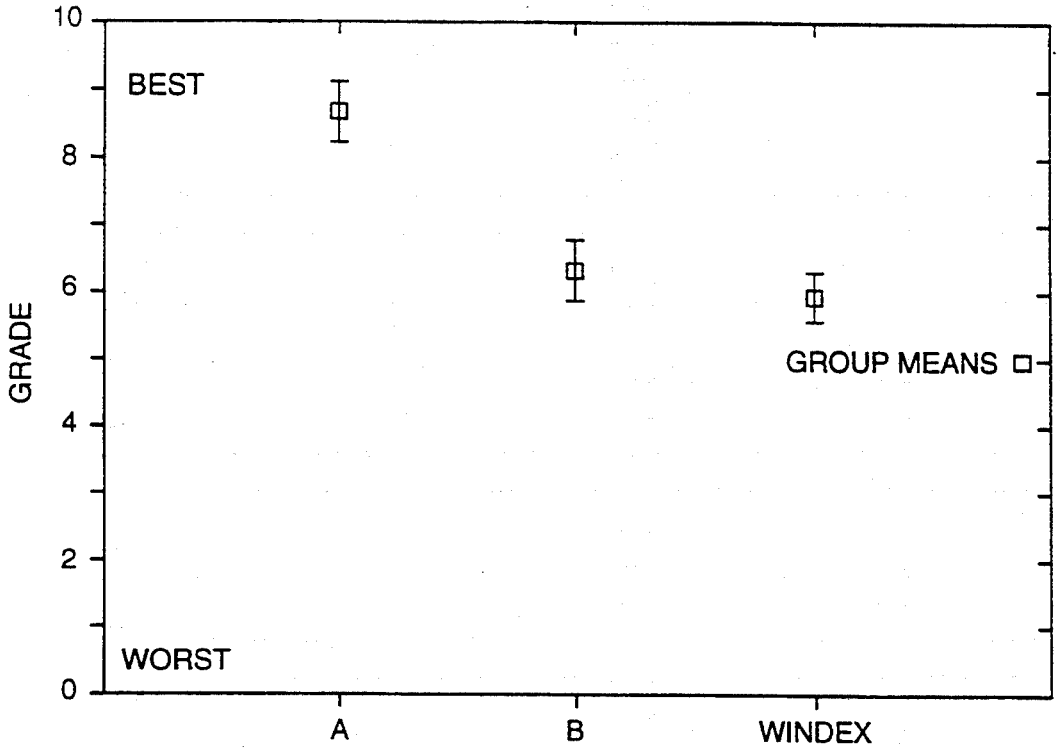
FIG. 9 is a still further graphical depiction of the streaking/filming performance of the inventive cleaner, including comparison versus a commercial window cleaner.

The inventive formulation A has better streaking-/filming performance that the inventive formulation B. This demonstrates the advantages of the preferred solvent, propyleneglycol t-butyl ether. Again, Windex cleaner was outperformed. This is graphically depicted in FIG. 9 of the accompanying drawings.

EXAMPLE X

In this Example, the significance of adding a 1-alkyl-2-pyrrolidone is studied with respect to soil removal cleaning performance, rather than streaking/filming performance, as in Example VIII, above. Surprisingly, the use of an alkylpyrrolidone significantly boosts soil removal performance as well, in comparison with two other formulations of the invention. The soil used here was "bathroom soil" and the results were graded on a 1–10 scale, with 1 being worst and 10 being best. The inventive formulations used as comparisons were B (ethoxylated phenols as the dispersant) and C (no dispersant). The formulations are described in Table X, below:

TABLE X

| Ingredient | Formulation Weight Percent | | |
|---|---|---|---|
| | A | B | C |
| Isopropanol | 5.90 | 5.90 | 5.90 |
| Propyleneglycol t-Butyl Ether | 3.20 | 3.20 | 3.20 |
| Sodium Lauryl Sulfate | 0.005 | 0.005 | 0.005 |
| Dodecylpyrrolidone | 0.012 | — | — |
| Ethoxylated Phenols | — | 0.012 | — |
| Cocoamidopropyldimethyl-betaine | 0.20 | 0.20 | 0.20 |
| Ammonium Carbamate | 0.25 | 0.25 | 0.25 |
| Fragrance | 0.125 | 0.125 | 0.125 |
| Ammonia | 0.05 | 0.05 | 0.05 |
| Deionized Water | Balance to 100% | Balance to 100% | Balance to 100% |

Figure 10:
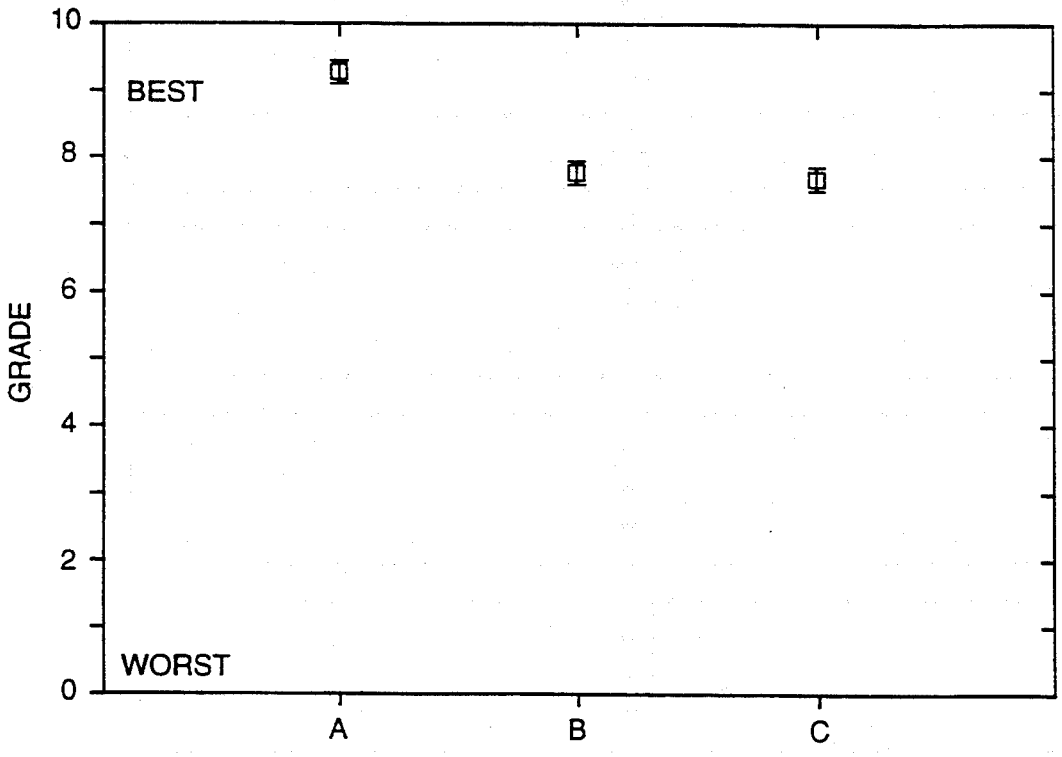
FIG. 10 is an even further graphical depiction of the soil removal performance of the inventive cleaner.

As can be seen from the results depicted in FIG. 10 of the accompanying drawings, the alkylpyrrolidone is the most preferred of the dispersants for fragrances in the invention, since it not only effectively disperses the fragrance, it also contributes both to excellent streaking/filming and soil removal performance.

EXAMPLE XI

In this example, the effect of adding soluble magnesium and calcium salts is studied. In very surprising fashion, it has been discovered that the addition of discrete amounts of alkaline earth salts improves filming/-streaking performance. It is not understood why this occurs, but by way of nonbinding theory, applicants speculate that the divalent alkaline earth cations do not bind or adhere as tightly to certain surfaces, such as glass, which are known to possess a negative charge. To the base formulation as shown in Table II above, solutions of NaCl, $MgCl_2$ and $CaCl_2$ were added to six of such base formulations in sufficient quantities to produce, respectively, one set containing 25 ppm of the specified salts, and the other set containing 50 ppm thereof. A control, without any added salt was also present for comparison. In this embodiment, all of these formulations fall within the invention. However, this example demonstrates the surprising performance benefits of adding soluble alkaline earth metal salts. The formulations are set forth in Table XI:

TABLE XI

| Ingredient | 25 ppm | 50 ppm | 25 ppm | 50 ppm |
|---|---|---|---|---|
| Base Formulation | 99.90 | 99.80 | 99.90 | 99.80 |
| NaCl stock solution | 0.10 | 0.20 | | |

TABLE XI-continued

| Ingredient | 25 ppm | 50 ppm | 25 ppm | 50 ppm |
|---|---|---|---|---|
| $MgCl_2 \times 6H_2O$ stock sol. | | | 0.10 | 0.20 |
| Base Formulation | 99.90 | 99.80 | | |
| $CaCl_2 \times 6H_2O$ stock sol. | 0.10 | 0.20 | | |

Figure 11:
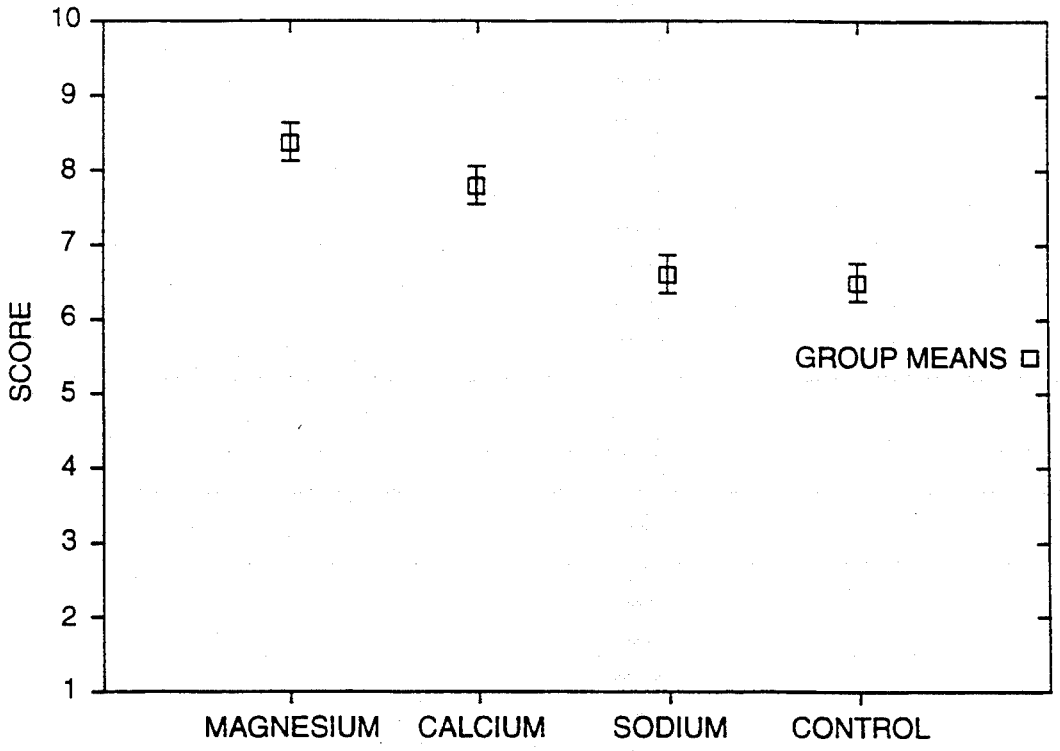
FIGS. 11–12 are graphical depictions of the streaking/filming performance of a further embodiment of the invention.
Figure 12:
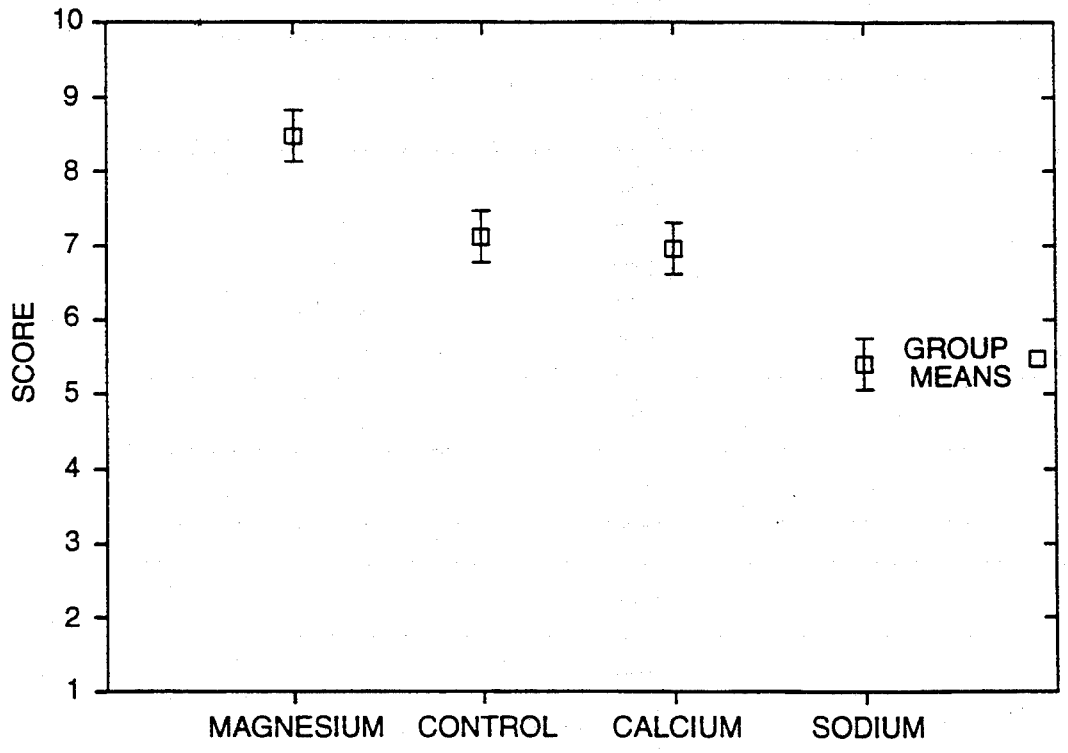

The results are depicted in FIGS. 11 (25 ppm level) and 12 (50 ppm level) of the accompanying drawings. As can be readily seen, addition of less than 100 ppm alkaline earth salts actually improved filming/streaking performance of the inventive cleaner.

The invention is further defined without limitation of scope or of equivalents by the claims which follow.

We claim:

1. An aqueous, hard surface cleaner with significantly improved residue removal and substantially reduced filming/streaking, said cleaner consisting essentially of:

(a) an effective amount of a solvent selected from $C_{1-6}$ alkanol, $C_{3-24}$ alkylene glycol ether, and mixtures thereof;

(b) an effective amount of a surfactant selected from amphoteric and anionic surfactants, and mixtures thereof, wherein the effective amount for the amphoteric surfactant is about 0.005–2% and for the anionic surfactant is about 0.001–1%, and, optionally, a further nonionic surfactant in an effective amount of about 0.75%;

(c) about 0.01–2% of a buffering system which comprises a nitrogenous buffer which is either ammonium or alkaline earth carbamate; and (d) the remainder as substantially all water.

2. The hard surface cleaner of claim 1 wherein said solvent is an alkanol which is selected from the group consisting of methanol, ethanol, n-propanol, isopropanol, butanol, pentanol, hexanol, their various positional isomers, and mixtures of the foregoing.

3. The hard surface cleaner of claim 1 wherein said solvent is an alkylene glycol ether which is selected from the group consisting of ethylene glycol monobutyl ether, ethylene glycol monopropyl ether, propylene glycol monopropyl ether, propylene glycol monobutyl ether, and mixtures thereof.

4. The hard surface cleaner of claim 3 wherein said solvent is propylene glycol t-butyl ether.

5. The hard surface cleaner of claim 1 wherein said surfactant further comprises a mixture of anionic and amphoteric surfactants.

6. The hard surface cleaner of claim 1 wherein said surfactant further comprises a mixture of anionic, nonionic and amphoteric surfactants.

7. The hard surface cleaner of claims 5 or 6 further comprising a soluble alkaline earth metal salt.

8. The hard surface cleaner of claim 7 wherein said alkaline earth metal salt is either $CaCl_2$ or $MgCl_2$.

9. The hard surface cleaner of claims 5 or 6, wherein said anionic surfactant is a $C_{6-20}$ alkyl sulfate and said amphoteric surfactant is an alkylbetaine.

10. The hard surface cleaner of claim 6 wherein said nonionic surfactant is a trialkyl amine oxide.

11. The hard surface cleaner of claim 1 wherein said buffer further includes an ammonium hydroxide.

12. A method for removing soil, without substantial residue remaining, from a hard surface comprising applying the cleaner of claim 1 to said soil and removing said soil and said cleaner.

* * * * *